US009705205B2

(12) United States Patent
Liu et al.

(10) Patent No.: US 9,705,205 B2
(45) Date of Patent: Jul. 11, 2017

(54) BI-POLARIZED BROADBAND ANNULAR RADIATION UNIT AND ARRAY ANTENNA

(71) Applicants: Comba Telecom System (China) Ltd, Guangdong Province (CN); Anhui Mobile Communication Co. Ltd., Anhui Province (CN)

(72) Inventors: Peitao Liu, Gaungzhou (CN); Qinyuan Wang, Gaungzhou (CN); Shan Qiu Sun, Gaungzhou (CN); Liwen Huang, Gaungzhou (CN); Yingchun Zhang, Gaungzhou (CN); Qing Tang, Gaungzhou (CN)

(73) Assignees: ANHUI MOBILE COMMUNICATION CO. LTD, Anhui Province (CN); COMBA TELECOM SYSTEM (CHINA) LTD, Guangdong Province (CN)

( * ) Notice: Subject to any disclaimer, the term of this patent is extended or adjusted under 35 U.S.C. 154(b) by 0 days.

(21) Appl. No.: 14/401,529

(22) PCT Filed: Feb. 19, 2013

(86) PCT No.: PCT/CN2013/071655
§ 371 (c)(1),
(2) Date: Nov. 16, 2014

(87) PCT Pub. No.: WO2013/170647
PCT Pub. Date: Nov. 21, 2013

(65) Prior Publication Data

US 2015/0102971 A1 Apr. 16, 2015

(30) Foreign Application Priority Data

May 18, 2012 (CN) ..... 2012 1 0157756

(51) Int. Cl.
*H01Q 21/26* (2006.01)
*H01Q 21/24* (2006.01)
(Continued)

(52) U.S. Cl.
CPC ..... *H01Q 21/26* (2013.01); *H01Q 1/246* (2013.01); *H01Q 19/108* (2013.01);
(Continued)

(58) Field of Classification Search
CPC ..... H01Q 21/26; H01Q 21/205; H01Q 1/246; H01Q 21/20; H01Q 21/24
(Continued)

(56) References Cited

U.S. PATENT DOCUMENTS

2007/0229385 A1* 10/2007 Deng ..... H01Q 1/246 343/797
2010/0309084 A1* 12/2010 Bu ..... H01Q 21/08 343/824

FOREIGN PATENT DOCUMENTS

CN 101425626 A 6/2009
CN 102176536 A 7/2011

* cited by examiner

*Primary Examiner* — Dameon E Levi
*Assistant Examiner* — Collin Dawkins
(74) *Attorney, Agent, or Firm* — Molins & Co. Pty Ltd

(57) ABSTRACT

A bi-polarized broadband annular radiation unit, for being installed on a metal reflective plate thus constituting a communication antenna and defining an annular construction by two pairs of orthogonally polarized dipoles, includes two pairs of orthogonally polarized dipoles, each dipole comprising two symmetrical unit arms of a single line sheet shape, one end of a unit arm being facing to a corresponding end of the other unit arm, and a distal end of each unit arm of at least one pair of dipoles is provided with a loading line; and a plurality of balun arms feeding power to and supporting respective dipoles, each balun arm including two parallel
(Continued)

balun lines, and the top ends of the two balun lines being connected with corresponding ends of the two unit arms of a corresponding dipole. Each unit arm and the balun line and/or loading line connected to the same unit arm are made by sheet metal stamping forming process or casting process.

5 Claims, 8 Drawing Sheets

(51) Int. Cl.

| | |
|---|---|
| ***H01Q 19/10*** | (2006.01) |
| ***H01Q 1/24*** | (2006.01) |
| ***H01Q 25/00*** | (2006.01) |
| *H01Q 21/08* | (2006.01) |
| *H01Q 5/42* | (2015.01) |

(52) U.S. Cl.
CPC ..... *H01Q 21/24* (2013.01); *H01Q 25/001* (2013.01); *H01Q 5/42* (2015.01); *H01Q 21/08* (2013.01)

(58) Field of Classification Search
USPC ..... 343/798, 799, 820, 821, 797
See application file for complete search history.

BI-POLARIZED BROADBAND ANNULAR RADIATION UNIT AND ARRAY ANTENNA

FIELD OF THE INVENTION

The invention relates to antennae used in mobile communications and more particularly, relates to a bi-polarized broadband annular radiation unit and a single frequency and dual frequency broadband array antennae incorporating the radiation unit.

BACKGROUND OF THE INVENTION

Currently, a bi-polarized broadband annular radiation unit is mainly formed by casting of zinc alloy. For example, Chinese Patent Application No.: CN101425626A filed by the present applicant Comba communication system (China) Ltd. and published on May 6, 2009 discloses bi-polarized broadband annular radiation unit. It includes the following parts: two pairs of orthogonally polarized dipoles for transmitting or receiving communication signals; and a balancer corresponding to each dipole for feeding power to the dipole in a balanced manner. Each dipole includes two unit arms symmetrically mounted on the respective balancer. Two arms are linearly symmetrical about the balancer. One end of each unit arm is secured onto the balancer, while the other end thereof is provided with a loading line extending vertically downwardly. In addition, a plurality of tuning bars with different cross section area from that of the unit arm is also provided. Though in terms of electric performance this kind of radiation unit brings contribution to the pertinent art, it suffers from large weight and high production cost due to formation by casting zinc alloy. In this context, radiation unit formed by sheet metal stamping has extensive application. It is a challenge for person of the art to apply this sheet metal stamping forming process and realize electrical performance of the radiation unit.

SUMMARY OF THE INVENTION

One object of the invention is to overcome drawbacks aforementioned and provide a bi-polarized broadband annular radiation unit formed by sheet metal stamping which eliminates problems such as complex forming process, heavy weight and huge cost caused during course of forming a bi-polarized broadband annular radiation unit using casting method.

Another object of the invention is to provide a broadband array antenna employing the above radiation unit.

To obtain the above objects, a technical solution is proposed as follows.

The bi-polarized broadband annular radiation unit of the instant invention is intended to be installed on a metal reflective plate thus constituting a communication antenna and defining an annular construction by two pairs of orthogonally polarized dipoles. It includes:

two pairs of orthogonally polarized dipoles, each dipole comprising two symmetrical unit arms of a single line sheet shape, one end of a unit arm being facing to a corresponding end of the other unit arm, and a distal end of each unit arm of at least one pair of dipoles is provided with a loading line; and a plurality of balun arms feeding power to and supporting respective dipoles, each balun arm including two parallel balun lines, and the top ends of the two balun lines being connected with corresponding ends of the two unit arms of a corresponding dipole.

Each unit arm and the balun line and/or loading line connected to the same unit arm are made by sheet metal stamping forming process or casting process.

Further, the respective balun arm are mounted onto a common base by bottom ends of their respective balun lines, and the entire radiation unit is integrally formed by sheet metal stamping process or casting process.

According what has been disclosed by various embodiments of the invention, the arrangement of the loading lines may be implemented by one of the following manners.

(1) All the dipoles are provided with loading lines, and adjacent loading lines of the adjacent dipoles are orthogonally arranged.

(2) The two loading lines of one of the two pairs of dipoles are all vertically downwardly orientated, while the other pair of the dipoles has their two loading lines all horizontally inwardly orientated; and adjacent loading lines of the adjacent dipoles are orthogonally arranged.

(3) The two loading lines of one of the two pairs of dipoles are all vertically downwardly orientated, while the other pair of the dipoles has their two loading lines all horizontally outardly orientated; and adjacent loading lines of the adjacent dipoles are orthogonally arranged.

(4) One of two unit arms of each pair of dipoles is provided with a vertically downwardly orientated loading line, while the other unit arm thereof is provided with a horizontally inwardly orientated loading line; and adjacent loading lines of the adjacent dipoles are arranged at a same direction.

(5) All the unit arms are provided with vertically downward or upward loading lines.

(6) All the unit arms are provided with downwardly or upwardly inclined loading lines.

(7) All the unit arms are provided with horizontally inward or outward loading lines.

(8) All the unit arms are provided with inwardly or outwardly inclined loading lines.

Preferably each unit arm is equipped with an adjusting block of uniform shape for adjusting matching performance of the entire radiation unit.

Preferably a plastic holding clip is placed between each unit arm of the respective dipoles and a corresponding balun arm for connection of the all vibrator arms with balun arms of the entire radiation unit, thus maintaining relative location between the vibrator arm and balun arm. In addition, this significantly enhances entire structural strength of the radiation unit and ensures uniformity of radiation units in batch production.

A broadband array antenna according to the invention includes a metal reflective plate operating as a reflector, wherein at least two radiation units as described above are linearly arranged on the metal reflective plate.

Compared to prior art, the invention gains the following advantages.

At first, the bi-polarized broadband annular radiation unit of the invention has simple structure and may be fabricated using aluminum by sheet metal stamping forming process or casting process and therefore it has good stability. Moreover, the weight of the product is further reduced such that uniformity is maintained for the product.

Secondly, the bi-polarized broadband annular radiation unit of the invention is made using sheet metal stamping forming process or casting process both of which are simple and inexpensive due to radiation unit of a single line sheet design.

Lastly, when the adjacent loading lines of the adjacent dipoles of the bi-polarized broadband annular radiation unit of the invention are orthogonally arranged, irrelevancy between two polarizations is improved; separation and radiation characteristics between two polarizations such as cross polarization resolution and the like are enhanced as well.

DETAILED DESCRIPTION OF THE INVENTION

The present invention is described in further detail in conjunction with various embodiments and accompanied drawings.

Figure 1:
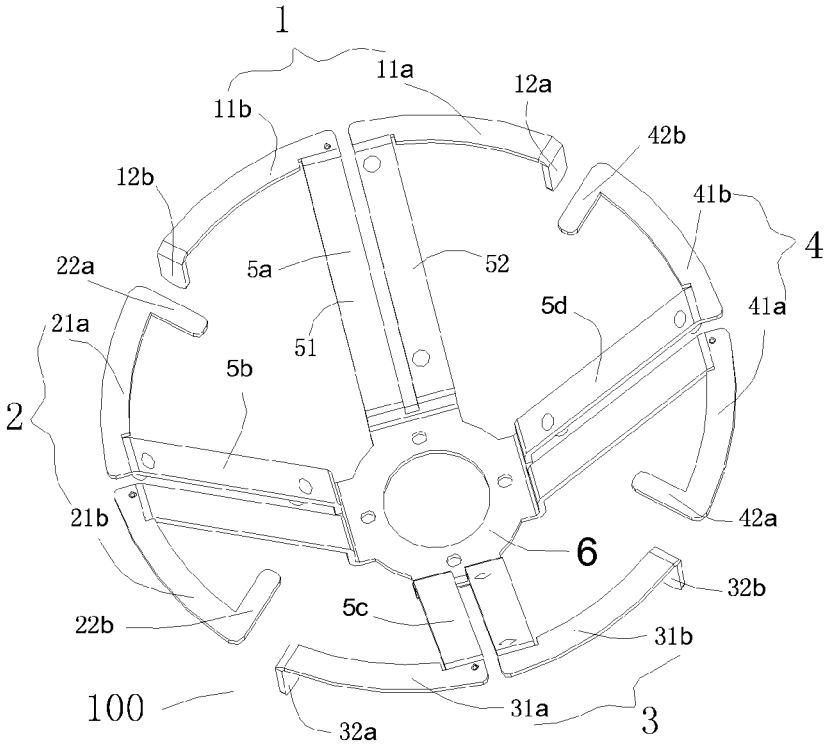
FIG. 1 shows a structural view of a first embodiment of a bi-polarized broadband annular radiation unit of the invention.
Figure 2:
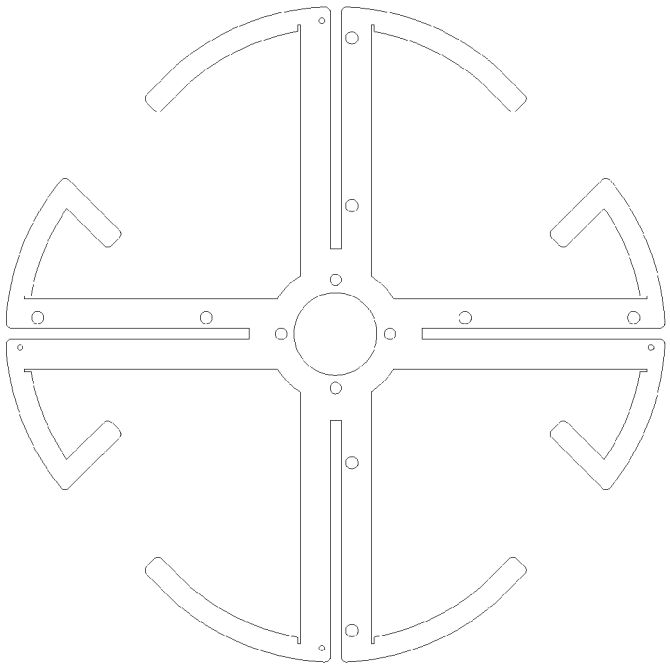
FIG. 2 shows an expanded view of a metal sheet of a first embodiment of a bi-polarized broadband annular radiation unit of the invention.
Figure 3:
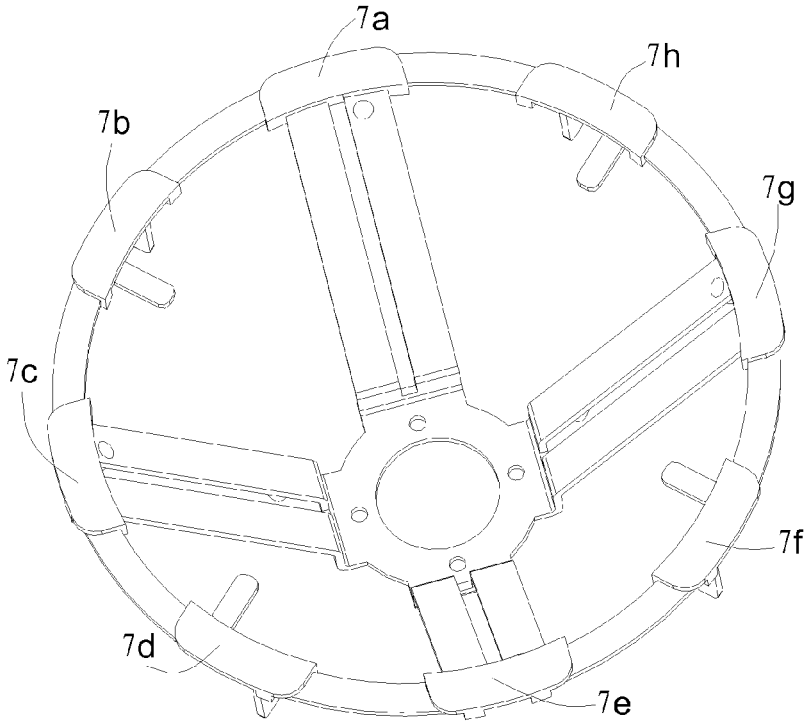
FIG. 3 shows structure of a first embodiment of a bi-polarized broadband annular radiation unit of the invention in which a plastic holding clip is used for holding purpose.

With reference to FIGS. 1, 2 and 3, according to a first embodiment of a bi-polarized broadband annular radiation unit of the invention, a radiation unit 100 includes two pairs of dipoles. Each pair of the dipoles includes two dipoles which are symmetrically and oppositely arranged. Each dipole is a vibrator unit and therefore, there are totally four vibrator units 1, 2, 3, and 4. Here, the vibrator units 1 and 3 are symmetrical about each other, and vibrator units 2 and 4 are also symmetrical about each other, thus achieving assembling of the radiation unit in a polarization-orthogonal manner.

In this case, each vibrator unit includes two unit arms one end of each unit arm is opposite to and separated from one end of the other unit arm. Each unit arm is of a single line sheet design. A distal end of each unit arm of the vibrator unit is provided with a loading line. The distal end of one unit arm is far away from a corresponding distal end of the other unit arm. The vibrator units 1-4 are held on balun arms 5*a*, 5*b*, 5*c*, and 5*d* respectively.

Specifically, the vibrator unit 1 includes two unit arms 11*a* and 11*b*. A loading line 12*a* is disposed on the unit arm 11*a* and a loading line 12*b* is disposed on the unit arm 11*b*. The two unit arms 11*a* and 11*b* are secured on the balun arm 5*b*. The vibrator unit 2 includes two unit arms 21*a* and 21*b*. A loading line 22*a* is disposed on the unit arm 21*a* and a loading line 22*b* is disposed on the unit arm 21*b*. The two unit arms 21*a* and 21*b* are secured on the balun arm 5*b*. The vibrator unit 3 includes two unit arms 31*a* and 31*b*. A loading line 32*a* is disposed on the unit arm 31*a* and a loading line 32*b* is disposed on the unit arm 31*b*. The two unit arms 31*a* and 31*b* are secured on the balun arm 5*c*. Similarly, the vibrator unit 4 includes two unit arms 41*a* and 41*b*. A loading line 42*a* is disposed on the unit arm 41*a* and a loading line 42*b* is disposed on the unit arm 41*b*. The two unit arms 41*a* and 41*b* are secured on the balun arm 5*d*. Based on orthogonal polarization design, all the unit arms of the entire radiation unit are annularly and symmetrically distributed. A first pair of dipoles, i.e., the vibrator units 1 and 3, has their loading lines be vertically downwardly oriented, while a second pair of dipoles, i.e., the vibrator units 2 and 4, has their loading lines be horizontally inwardly oriented. The adjacent loading lines of the adjacent vibrator units are orthogonally arranged. In other words, the loading line 12*a* is orthogonal to the loading line 42*b*; the loading line 12*b* is orthogonal to the loading line 22*a*; the loading line 22*b* is orthogonal to the loading line 32*a*; and the loading line 32*b* is orthogonal to the loading line 42*a*. The vibrator units 1-4 share a common base 6. In practical application, according to certain requirement, the loading lines of the adjacent vibrator units may be angled to each other for example the lines may be suitable inclined such as inwardly or outwardly. In present embodiment, as the orthogonal solution is the first consideration, vertical downward and horizontal inward configuration is employed.

Each balun arm includes a pair of parallel balun lines 51 and 52. A bottom end of each balun line is installed on the base 6, while the other end thereof is connected to one end of a unit arm facing a corresponding end of the other unit arm. Accordingly, top ends of the two balun lines 51 and 52 are connected with the ends, which are facing to each other, of the two unit arms of the same vibrator units. Moreover, all the balun arms are arranged on the base 6 and take the shape of horn.

In this embodiment, the entire radiation unit 100 including the vibrator units 1-4, balun arms 5*a*-5*d*, and base 6 are integrally formed of preferably aluminum by sheet metal stamping forming process. The radiation units 100 prepared by sheet metal stamping forming method, together with orthogonal design of the adjacent loading lines of adjacent vibrator units, might improve irrelevancy between two polarizations of the radiation unit 100, enhance separation and radiation characteristics between two polarizations such as cross polarization resolution and the like.

Figure 4:
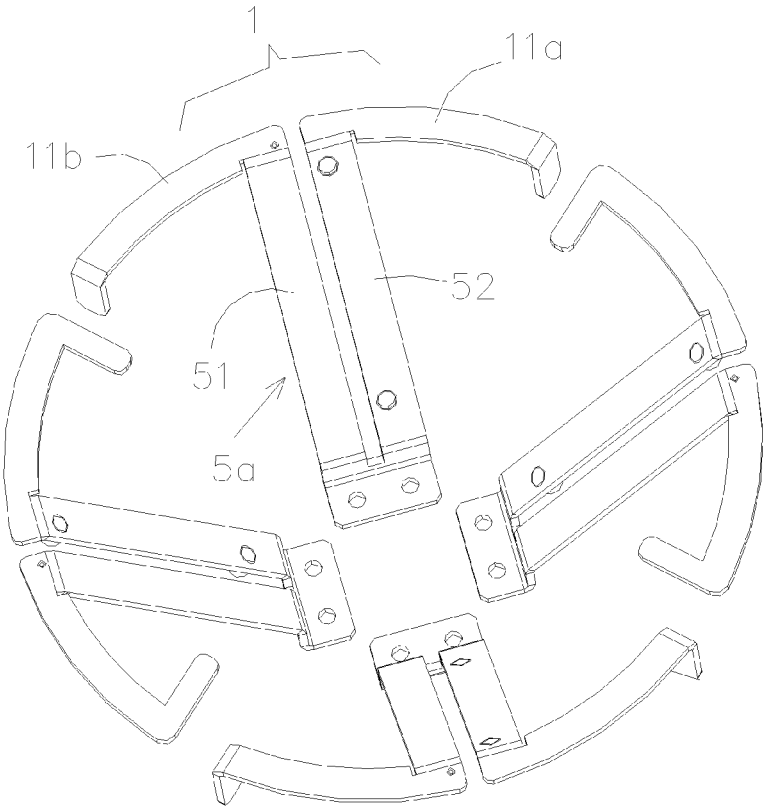
FIG. 4 shows a structural view of a second embodiment of a bi-polarized broadband annular radiation unit of the invention.

In this embodiment, regarding the entire radiation unit 100, all its component including all vibrator arms and balun arms are suitable held in place by eight plastic holding clips 7*a*, 7*b*, 7*c*, 7*d*, 7*e*, 7*f*, 7*g*, and 7*h*, thus all the vibrator arms and balun arms of the radiation unit being formed as an entity, maintaining relative locations among these vibrator arms and balun arms, and dramatically improving structural strength of the radiation unit. Reference is made to FIG. 4. According to a second embodiment of a bi-polarized broadband annular radiation unit of the invention, the same construction as that disclosed in aforementioned embodiment is employed. There is also difference in this embodiment. A component consisted of a vibrator unit 1 and a corresponding balun arm (such as balun arm 5*a*), in other word, consisted of two unit arms (for example arms 11*a* and 11*b*) of the same vibrator unit (such as unit 1) and two balun lines 51 and 52 of the same balun arm, is an integral and independent component, and it may be assembled together with a separate base.

Figure 5:
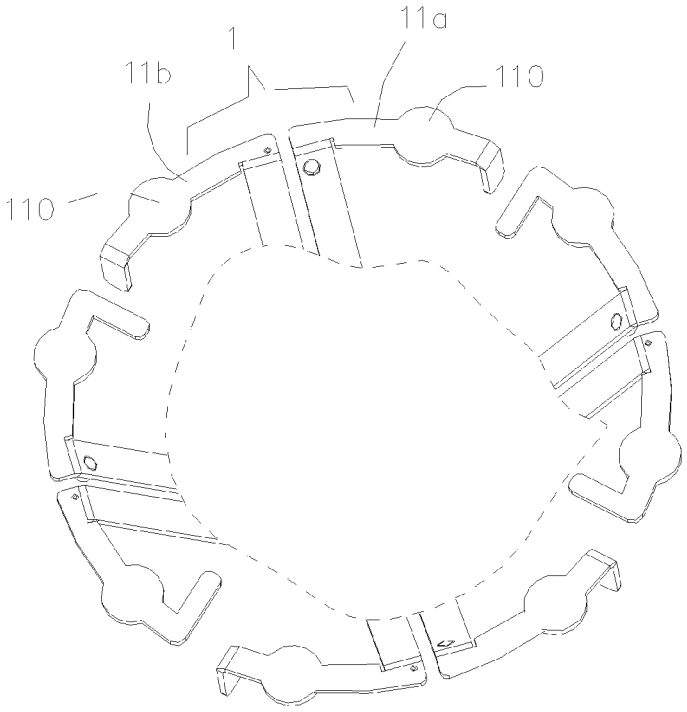
FIG. 5 shows a structural view of a third embodiment of a bi-polarized broadband annular radiation unit of the invention.

Reference is made to FIG. 5. According to a third embodiment of a bi-polarized broadband annular radiation unit of the invention, the same construction as that disclosed in aforementioned embodiments is employed. The difference lies in implementation of respective unit arm. All the unit arms of the entire radiation unit 100 (such as unit arms 11*a* and 11*b*) each have an adjusting block 110 at a corresponding symmetrical location. In this embodiment, the adjusting block 110 is of a disk shape.

Figure 6:
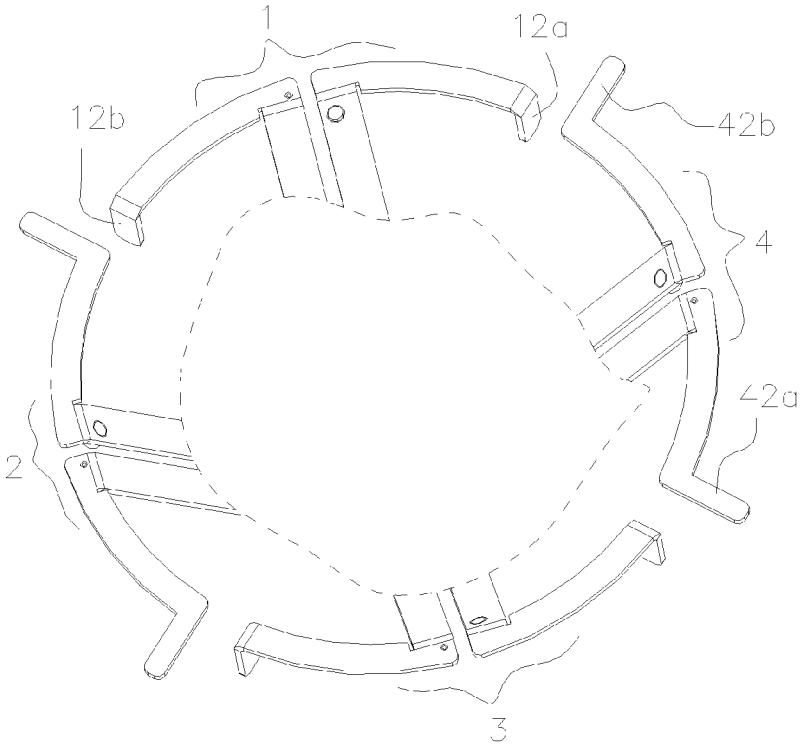
FIG. 6 shows a structural view of a fourth embodiment of a bi-polarized broadband annular radiation unit of the invention.

Reference is made to FIG. 6. According to a fourth embodiment of a bi-polarized broadband annular radiation unit of the invention, the same base and balun arm are used as those disclosed in the first or second embodiment of the invention. The difference lies in implementation of the vibrator loading lines. Here, the loading lines (such as those labeled 12*a* and 12*b*) of a pair of dipoles 1 and 3 are vertically downwardly orientated, while the loading lines (such as those labeled 42*a* and 42*b*) of another pair of dipoles 2 and 4 are horizontally outwardly orientated. By this manner, for two pairs of dipoles, the adjacent loading lines of the adjacent dipoles are still orthogonal to each other.

Figure 7:
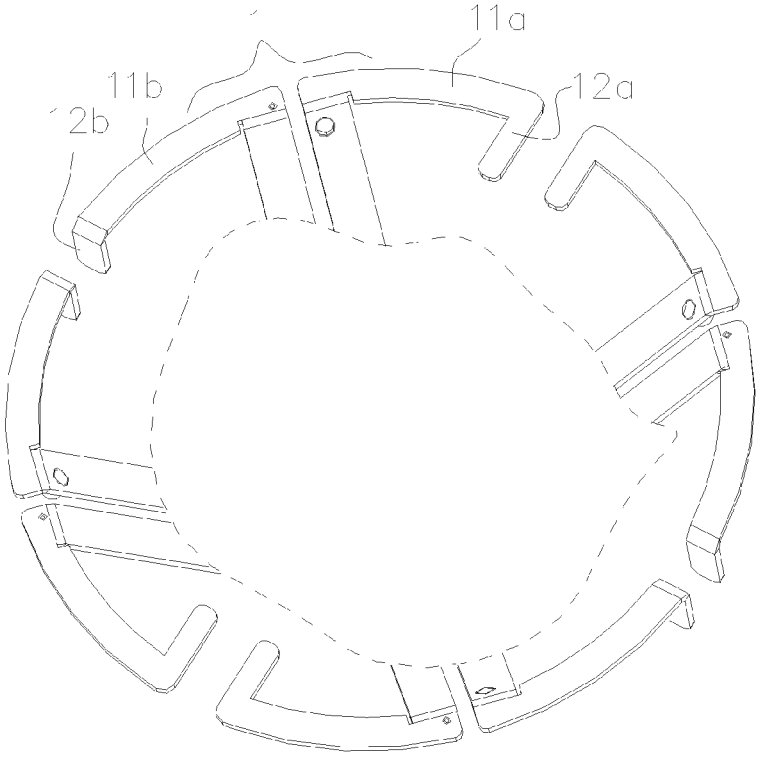
FIG. 7 shows a structural view of a fifth embodiment of a bi-polarized broadband annular radiation unit of the invention.

Reference is made to FIG. 7. According to a fifth embodiment of a bi-polarized broadband annular radiation unit of the invention, the same base and balun arm are used as those disclosed in the first or second embodiment of the invention. The difference lies in implementation of the vibrator loading lines. The loading lines (such as those labeled 12*a* and 12*b*) disposed two distal ends of the two unit arms (such as those labeled 11*a* and 11*b*) respectively of each vibrator unit (for example one labeled 1) are asymmetrically arranged. Here, for example, the loading line 12*a* on one unit arm 11*a* is horizontally arranged, while the loading line 12*b* on the another unit arm 11*b* is vertically downwardly arranged. Comparatively, the adjacent loading lines of the adjacent dipoles are symmetrical and oriented in the same direction.

Figure 8:
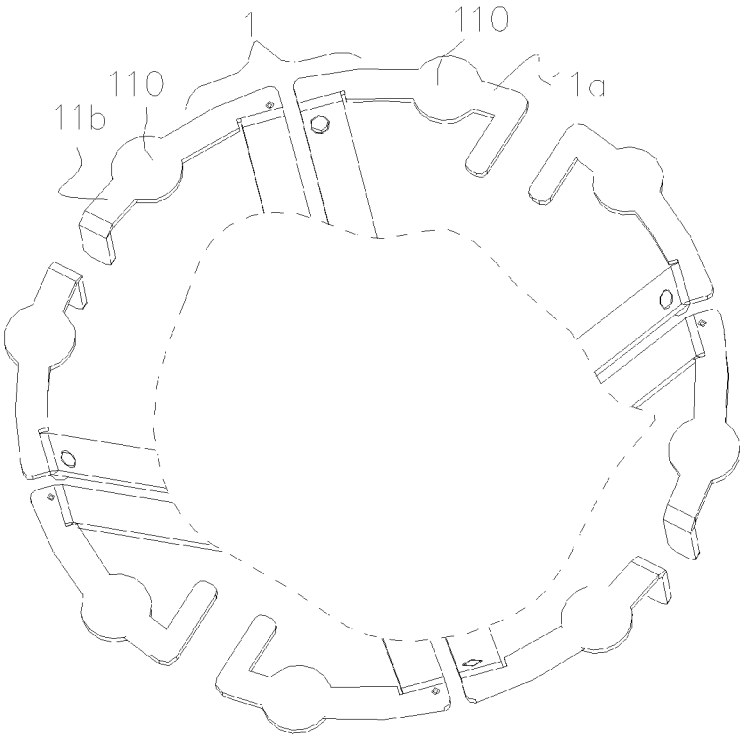
FIG. 8 shows a structural view of a sixth embodiment of a bi-polarized broadband annular radiation unit of the invention.

Reference is made to FIG. 8. According to a sixth embodiment of a bi-polarized broadband annular radiation unit of the invention, the same construction as that of the fifth embodiment is employed and the difference lies in implementation of the unit arm. In this embodiment, the entire unit arms (such as those labeled 11*a* and 11*b*) of the entire radiation unit each have an adjusting block 110 at a corresponding symmetrical location. In this embodiment, the adjusting block 110 is of a disk shape.

Figure 9:
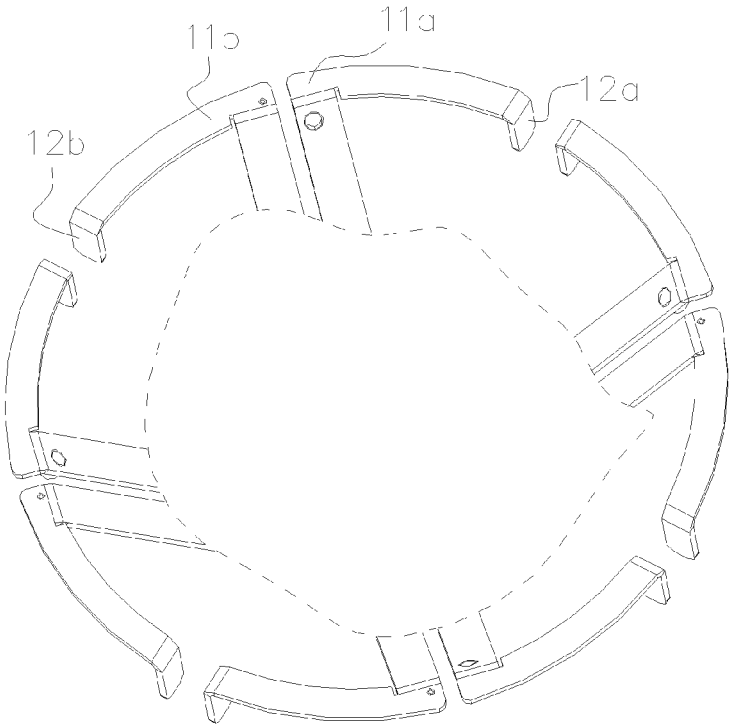
FIG. 9 shows a structural view of a seventh embodiment of a bi-polarized broadband annular radiation unit of the invention.

Reference is made to FIG. 9. According to a seventh embodiment of a bi-polarized broadband annular radiation unit of the invention, the same base and balun arm are used as those disclosed in the first or second embodiment of the invention. The difference lies in implementation of the vibrator loading lines. Here, all the loading lines (e.g. 12*a* and 12*b*) of the unit arms (such as 11*a* and 11*b*) are vertically downwardly arranged.

Figure 10:
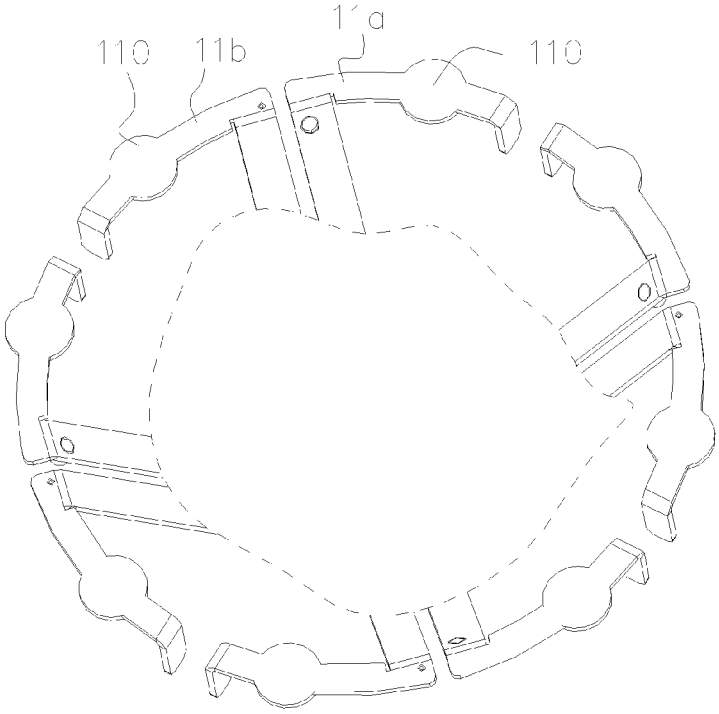
FIG. 10 shows a structural view of an eighth embodiment of a bi-polarized broadband annular radiation unit of the invention.

Reference is made to FIG. 10. According to an eighth embodiment of a bi-polarized broadband annular radiation unit of the invention, the same construction is used as that of the seventh embodiment. The difference lies in implementation of the unit arms of the dipole. In this embodiment, the entire unit arms (such as those labeled 11*a* and 11*b*) of the entire radiation unit each have an adjusting block 110 at corresponding symmetrical locations. In this embodiment, the adjusting block 110 is of a disk shape.

Figure 11:
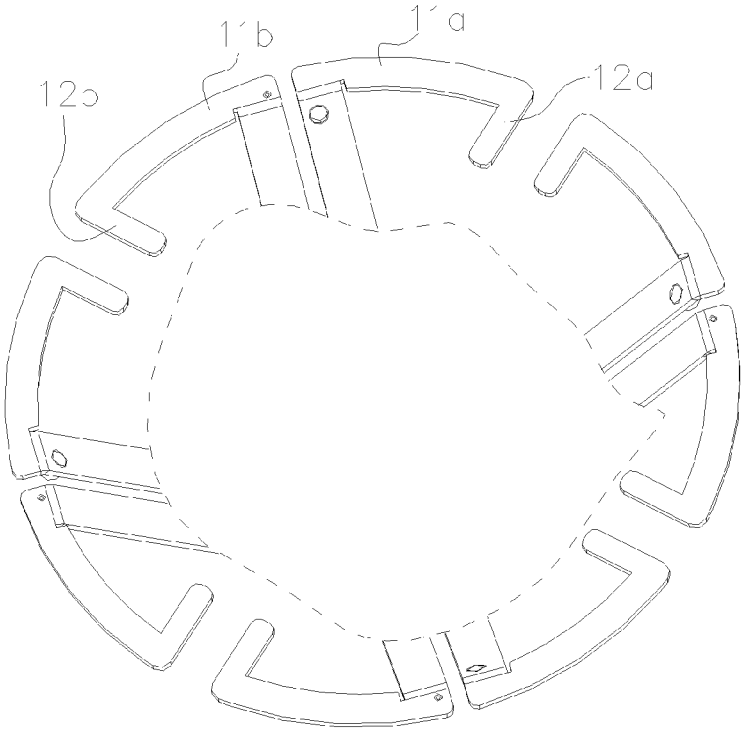
FIG. 11 shows a structural view of a ninth embodiment of a bi-polarized broadband annular radiation unit of the invention.

Reference is made to FIG. 11. According to a ninth embodiment of a bi-polarized broadband annular radiation unit of the invention, the same base and balun arm are used as those disclosed in the first or second embodiment of the invention. The difference lies in implementation of the loading lines. The loading lines (such as those labeled 12*a* and 12*b*) disposed on the unit arms (such as those labeled 11*a* and 11*b*) respectively of entire radiation unit are horizontally inwardly orientated.

Figure 12:
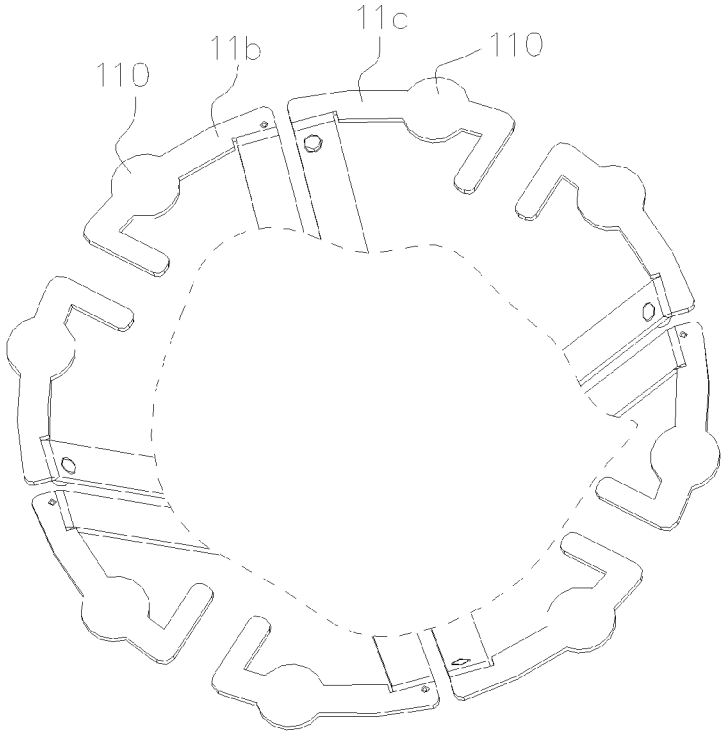
FIG. 12 shows a structural view of a tenth embodiment of a bi-polarized broadband annular radiation unit of the invention.

Reference is made to FIG. 12. According to a tenth embodiment of a bi-polarized broadband annular radiation unit of the invention, the same construction is used as that of the ninth embodiment. The difference lies in implementation of the unit arms of the dipole. In this embodiment, the entire unit arms (such as those labeled 11*a* and 11*b*) of the entire radiation unit each have an adjusting block 110 at a corresponding symmetrical location. In this embodiment, the adjusting block 110 is of a disk shape.

Figure 13:
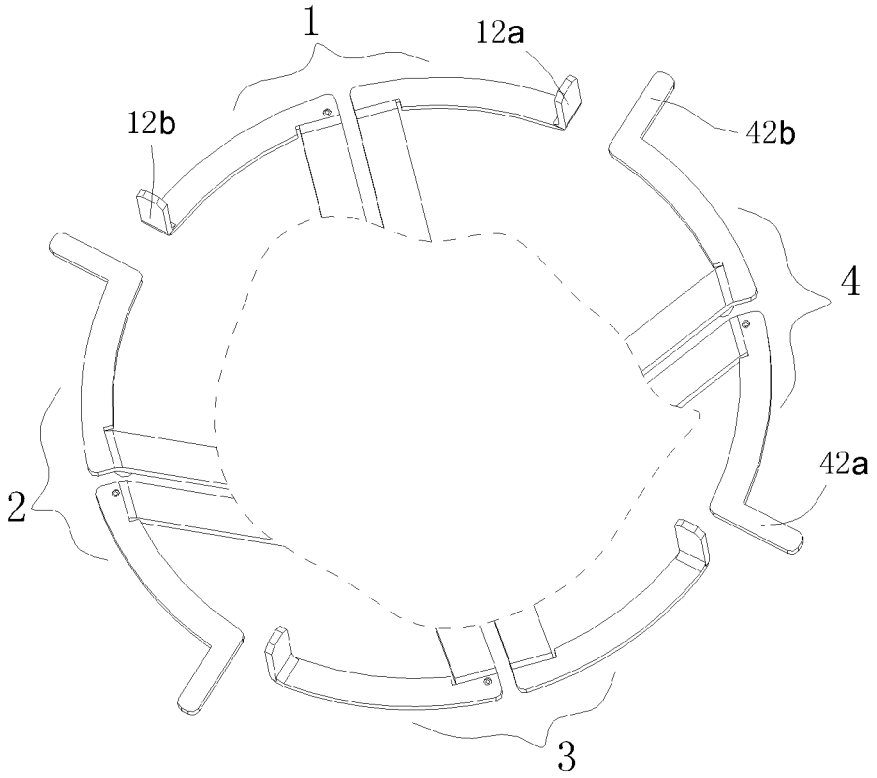
FIG. 13 shows a structural view of an eleventh embodiment of a bi-polarized broadband annular radiation unit of the invention.
Figure 14:
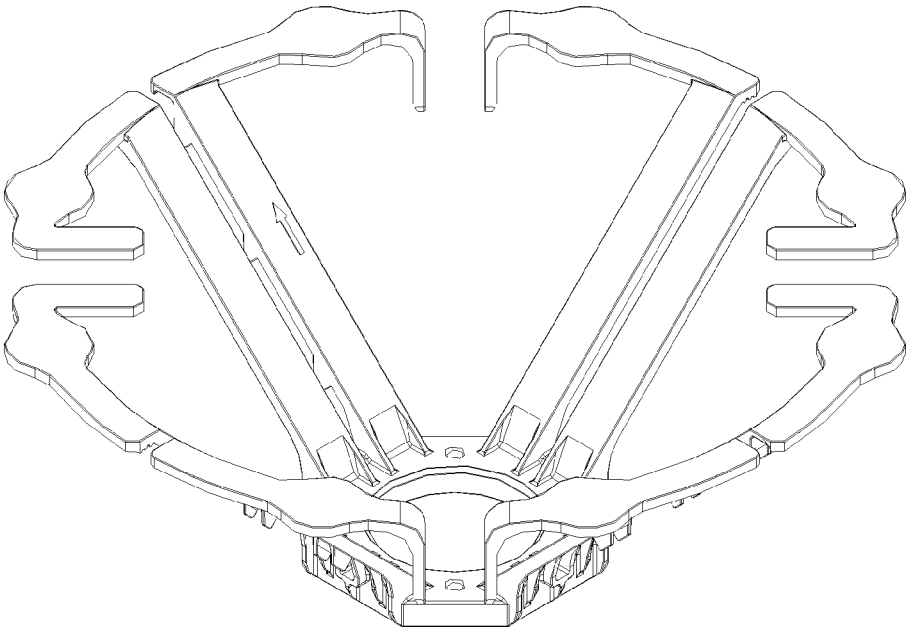
FIGS. 14 and 15 respectively show structural views of a twelfth embodiment of a bi-polarized broadband annular radiation unit of the invention illustrating from different perspectives.
Figure 15:
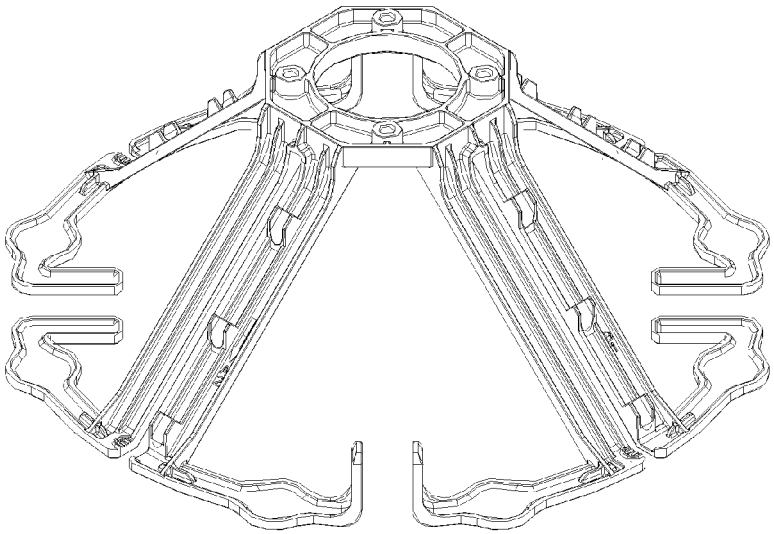

Reference is made to FIG. 13. According to an eleventh embodiment of a bi-polarized broadband annular radiation unit of the invention, the same base and balun arm are used as those disclosed in the first or second embodiment of the invention. The difference lies in implementation of the vibrator loading lines. The loading lines (such as those labeled 12*a* and 12*b*) of a pair of dipoles 1 and 3 are vertically downwardly orientated, while those (such as ones labeled 42*a* and 42*b*) of another pair of dipoles 2 and 4 are horizontally outwardly orientated. By this manner, for two pairs of the dipoles, the adjacent loading lines of the adjacent dipoles are still orthogonal to each other. Please refer to FIGS. 14 and 15, in accordance with a twelfth embodiment of a bi-polarized broadband annular radiation unit of the invention, the same construction as that disclosed in previous ten embodiments may be utilized. The difference lies in a different process, i.e., a casting forming process is used for the radiation unit.

No matter what kinds of processes have been used to make the bi-polarized broadband annular radiation unit of the invention, they all benefit from the improvement of the unit arm of the invention. In present invention, the unit arm is designed to have a single line sheet configuration thus further simplifying structure and making it easy to form the unit arm integrally.

In this instant invention, in addition to aforementioned embodiments, the design of the loading lines may be flexibly adjusted by a person of the art in light of the designs contained in above embodiments. For example, tilt of the loading lines may be suitable adjusted and, it is unnecessary to limit orientation of the loading lines to vertically downward orientation or horizontally inward or outward orientation.

Figure 16:
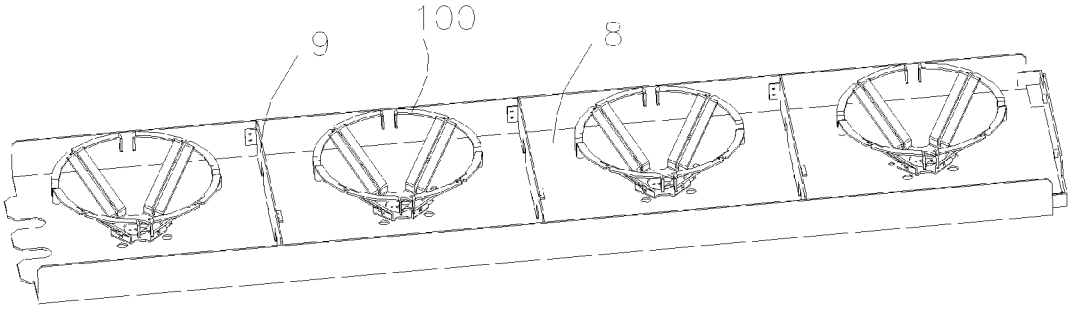
FIG. 16 shows a perspective view of a single frequency broadband array antenna formed by the radiation units of the invention.
Figure 17:
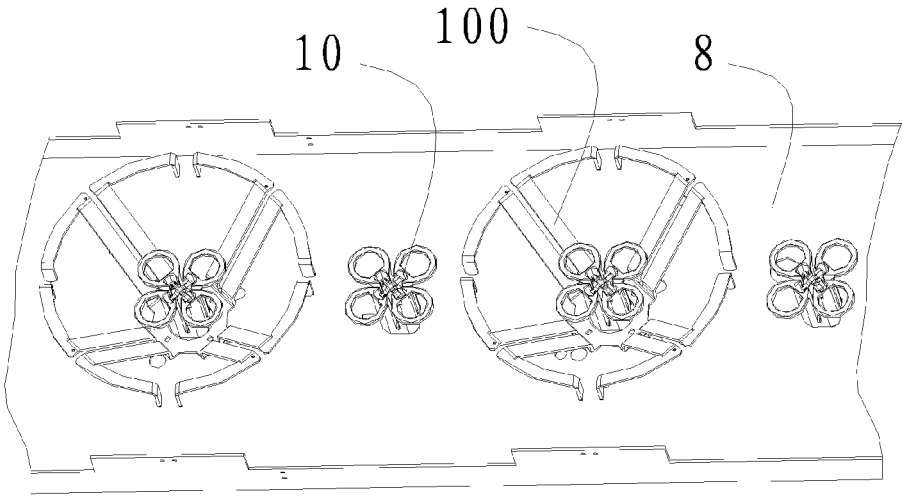
FIG. 17 shows a perspective view of a dual frequency broadband array antenna formed by the radiation units of the invention.

The bi-polarized broadband annular radiation unit of the invention is majorly used to form a base station antenna of a mobile communication system for example an array antenna shown in FIGS. 16 and 17 together.

As shown in FIG. 16, the array antenna includes a metal reflective plate, a number of separation plats 9, and a number of radiation units 100 as described above. The radiation units are linearly arranged on the metal reflective plate so as to realize power feeding in a parallel manner. This kind of array antenna is a single frequency broadband array antenna.

FIG. 17 illustrates a dual frequency broadband array antenna. Different from that shown in FIG. 16, the array antenna in this case is realized by disposing plural high frequency radiation units 10 on the arrange axis of the radiation unit of the invention. The radiation unit of the invention works as a low frequency radiation unit. At least one high frequency radiation unit 10 is placed in the radiation units of the invention. The high frequency radiation unit 10 is not limited to that shown in FIG. 17.

Apparently, the application of the radiation unit of the invention is by no means limited to array antenna and therefore, it in fact may also be used in other publicly known antenna which incorporating a bi-polarized radiation unit.

In contrast to the antenna, the metal reflective plate 8 is a threshold condition for obtain specific radiation property. In this situation, the construction of the plate should be consistent to the vibrator arms of the antenna radiation unit, and configuration and size thereof should also be optimized for example by means of antenna simulation software.

It is evidenced that the antenna made according to the invention has the benefits of simple and compact construction, high performance, easy formation, low cost and simple assembling process.

Though various embodiments of the invention have been illustrated above, a person of ordinary skill in the art will understand that, variations and improvements made upon the illustrative embodiments fall within the scope of the invention, and the scope of the invention is only limited by the accompanying claims and their equivalents.

The invention claimed is:

1. A bi-polarized broadband annular radiation unit for being installed on a metal reflective plate thus constituting a communication antenna and defining an annular construction by two pairs of orthogonally polarized dipoles, comprising:

two pairs of orthogonally polarized dipoles, each dipole comprising two symmetrical unit arms of a single line sheet shape, one end of a unit arm being facing to a corresponding end of the other unit arm, and a distal end of each unit arm of at least one pair of dipoles is provided with a loading line; and a plurality of balun arms feeding power to and supporting respective dipoles, each balun arm comprising two parallel balun lines, and the top ends of the two balun lines being connected with corresponding ends of the two unit arms of a corresponding dipole; wherein the two loading lines of one of the two pairs of dipoles are all vertically downwardly or upwardly orientated, while the other pair of the dipoles have their two loading lines all horizontally inwardly orientated; and adjacent loading lines of the adjacent dipoles are orthogonally arranged; and the entire radiation unit is integrally formed.

2. A bi-polarized broadband annular radiation unit for being installed on a metal reflective plate thus constituting a communication antenna and defining an annular construction by two pairs of orthogonally polarized dipoles, comprising:

two pairs of orthogonally polarized dipoles, each dipole comprising two symmetrical unit arms of a single line sheet shape, one end of a unit arm being facing to a corresponding end of the other unit arm, and a distal end of each unit arm of at least one pair of dipoles is provided with a loading line; and a plurality of balun arms feeding power to and supporting respective dipoles, each balun arm comprising two parallel balun lines, and the top ends of the two balun lines being connected with corresponding ends of the two unit arms of a corresponding dipole; wherein the two loading lines of one of the two pairs of dipoles are all vertically downwardly or upwardly orientated, while the other pair of the dipoles have their two loading lines all horizontally outwardly orientated; and adjacent loading lines of the adjacent dipoles are orthogonally arranged; and the entire radiation unit is integrally formed.

3. A bi-polarized broadband annular radiation unit for being installed on a metal reflective plate thus constituting a communication antenna and defining an annular construction by two pairs of orthogonally polarized dipoles, comprising:

two pairs of orthogonally polarized dipoles, each dipole comprising two symmetrical unit arms of a single line sheet shape, one end of a unit arm being facing to a corresponding end of the other unit arm, and a distal end of each unit arm of at least one pair of dipoles is provided with a loading line; and a plurality of balun arms feeding power to and supporting respective dipoles, each balun arm comprising two parallel balun lines, and the top ends of the two balun lines being connected with corresponding ends of the two unit arms of a corresponding dipole; wherein one of two unit arms of each pair of dipoles is provided with a vertically upwardly orientated loading line, while the other unit arm thereof is provided with a horizontally inwardly orientated loading line; and adjacent loading lines of the adjacent dipoles are arranged at a same direction; and the entire radiation unit is integrally formed.

4. A bi-polarized broadband annular radiation unit for being installed on a metal reflective plate thus constituting a communication antenna and defining an annular construction by two pairs of orthogonally polarized dipoles, comprising:

two pairs of orthogonally polarized dipoles, each dipole comprising two symmetrical unit arms of a single line sheet shape, one end of a unit arm being facing to a corresponding end of the other unit arm, and a distal end of each unit arm of at least one pair of dipoles is provided with a loading line; and a plurality of balun arms feeding power to and supporting respective dipoles, each balun arm comprising two parallel balun lines, and the top ends of the two balun lines being connected with corresponding ends of the two unit arms of a corresponding dipole; wherein all the unit arms are provided with horizontally inward or outward loading lines; and the entire radiation unit is integrally formed.

5. A bi-polarized broadband annular radiation unit for being installed on a metal reflective plate thus constituting a communication antenna and defining an annular construction by two pairs of orthogonally polarized dipoles, comprising:

two pairs of orthogonally polarized dipoles, each dipole comprising two symmetrical unit arms of a single line sheet shape, one end of a unit arm being facing to a corresponding end of the other unit arm, and a distal end of each unit arm of at least one pair of dipoles is provided with a loading line; and a plurality of balun arms feeding power to and supporting respective dipoles, each balun arm comprising two parallel balun lines, and the top ends of the two balun lines being connected with corresponding ends of the two unit arms of a corresponding dipole; wherein each unit arm is equipped with an adjusting block of uniform shape for adjusting matching performance of the entire radiation unit; and the entire radiation unit is integrally formed.

* * * * *